United States Patent [19]

Mosch

[11] 4,356,677

[45] Nov. 2, 1982

[54] SYSTEM WALL OR SYSTEM CEILING

[76] Inventor: Theodorus W. Mosch, Kanaalkade 66, t'Zand, Netherlands

[21] Appl. No.: 134,810

[22] Filed: Mar. 28, 1980

[30] Foreign Application Priority Data

Dec. 27, 1979 [NL] Netherlands ..... 7909311

[51] Int. Cl.[3] ..... E04B 5/57

[52] U.S. Cl. ..... 52/489; 52/775

[58] Field of Search ..... 52/482, 484, 489, 715, 52/762, DIG. 6, 765, 778, 363, 361, 356, 508, 486, 444, 764, 779, 773, 144, 357, 362, 782, 813, 391, 385, 522, 744, 775

[56] References Cited

U.S. PATENT DOCUMENTS

| | | | |
|---|---|---|---|
| 344,408 | 6/1886 | Scarles | 52/715 |
| 1,974,259 | 9/1934 | Cherry | 52/765 |
| 2,133,002 | 10/1938 | Wallace | 52/508 |
| 2,150,459 | 3/1939 | Reintjes | 52/778 |
| 2,150,997 | 3/1939 | Venzie | 52/483 |
| 2,209,514 | 7/1940 | Drummond | 52/483 |
| 2,282,624 | 5/1942 | Upson | 52/361 |
| 2,581,843 | 1/1952 | Edwards | 52/775 |
| 3,005,293 | 10/1961 | Hunter | 52/489 |
| 3,175,656 | 3/1965 | Schoenfeld | 52/778 |
| 3,248,838 | 5/1966 | Stark | 52/508 |
| 3,277,622 | 10/1966 | Jensen | 52/489 |
| 3,473,288 | 10/1969 | Meyer | 24/295 |
| 3,594,028 | 7/1971 | Scott | 52/465 |
| 4,033,083 | 7/1977 | Fritz | 52/385 |

FOREIGN PATENT DOCUMENTS

| | | | |
|---|---|---|---|
| 561466 | 10/1957 | Belgium | 52/385 |

*Primary Examiner*—John E. Murtagh

*Attorney, Agent, or Firm*—Pollock, Vande Sande & Priddy

[57] ABSTRACT

A system wall or system ceiling comprising a number of supporting girders suspended from the structure of the building and to which slabs are mounted substantially extending perpendicular to the girders, the girders being provided with outwardly or downwardly protruding clamping feet engaging into one or more slits, cut into the upper or back side of the slabs.

3 Claims, 4 Drawing Figures

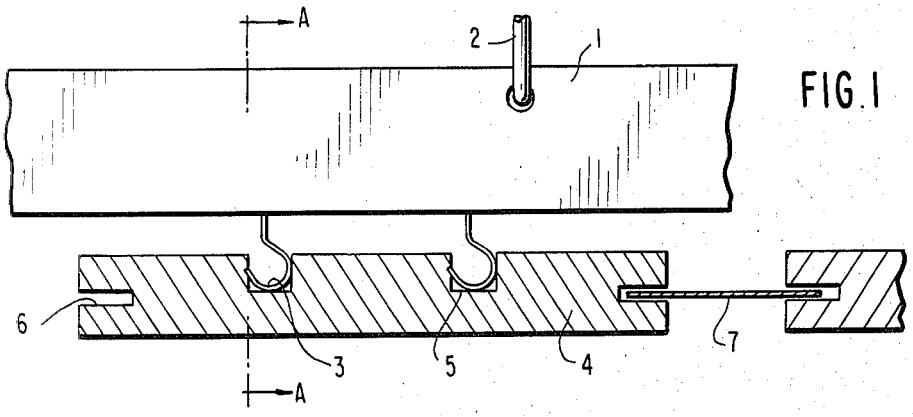
FIG. 1
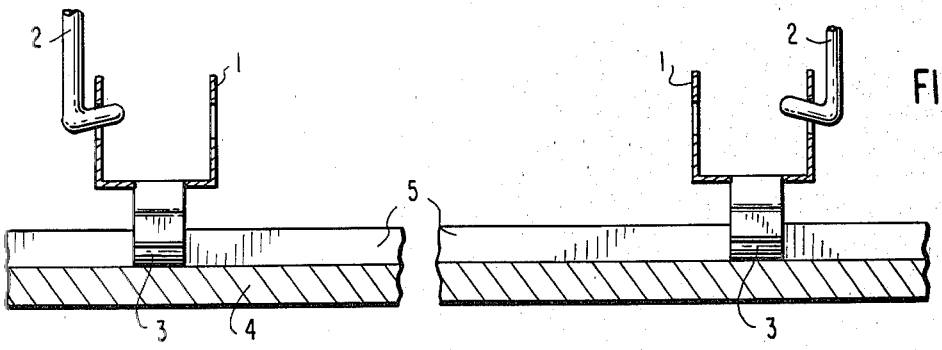
FIG. 2
FIG. 3
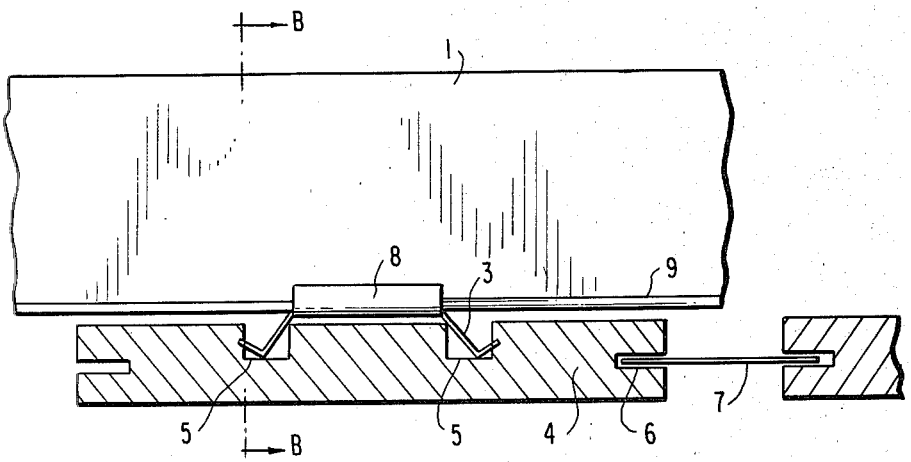
FIG. 4
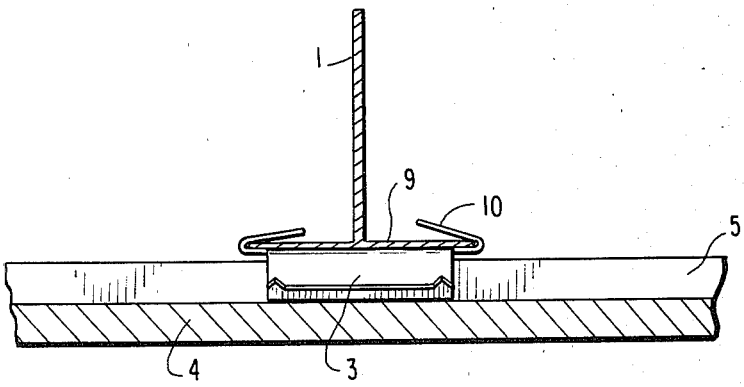

SYSTEM WALL OR SYSTEM CEILING

BACKGROUND OF THE INVENTION

The present invention relates to a system wall or system ceiling comprising a number of supporting girders suspended from the structure of the building and to which slabs are mounted substantially extending perpendicular to the girders.

Such a system ceiling is known in which the slabs are mounted to the girders by means of fastening members clamped or pushed onto the girders and which are provided with sheet metal strips directed downwardly to the slabs, and of which the end portions flanged at right angles engage saw cuts applied into the sides of the slabs.

This manner of mounting the slabs to the girders has the drawback, that on occurrence of shrinkage or buckling of the slabs, these slabs become insufficiently retained by the fastening members and may shift with respect to each other, so that the spacing between the succeeding slabs which are generally bridged by the so called firet strips, will show differences.

By the firet strips which, to obtain a decorative effect, may have a contrasting tint with respect to the slabs, and which also are slipped into the saw cuts at the sides of the slabs, the mutual differences in spacing between the slabs further is accented.

Also, on shrinkage of the slabs, the firet strips may become free from the saw cuts, which causes a very defacing effect to the known system ceiling.

It is an object of the present invention to remove these drawbacks of the known system ceiling.

SUMMARY OF THE INVENTION

According to the present invention the system wall or system ceiling is characterized in that the girders are provided with outwardly or downwardly protruding clamping feet engaging into one or more slits, cut into the upper or back side of the slabs.

To apply the slabs to the girders suspended from the structure of the building, the slabs may simply be pressed with the slits across the clamping feet of the girders.

In a favourable embodiment of the invention, the clamping feet are formed by sheet metal strips of which the ends are bent to form barbs.

In this embodiment the slabs, after being pressed across the clamping feet, are efficiently prevented from moving back, and a firm connection between the slabs and the girders is ensured.

In another favourable embodiment of the invention, the ends of the clamping feet cooperating with the slabs are bent in opposite directions and substantially perpendicular to the length direction of the slabs and the slits cut therein, to form oppositely directed barbs.

In this embodiment the clamping feet introduced into the slits hook into both opposite side walls of the slits so that a double security is obtained against the lossening of the clamping feet from the slabs.

The number of slits in a slab for cooperating with the clamping feet may vary.

Preferably two spaced and symmetrically with respect to the middle plane of the slabs extending slits are applied.

In the ceiling system of the present invention, the slabs are completely secured against shifting by the mounting by clamping feet introduced into the slits at the upper or back side of the slabs, so that the drawbacks of the known systems are completely met.

The clamping feet may be connected to the sheet metal girders in various manners.

In a favourable embodiment of the invention, the clamping feet form a whole with the girders.

Favourably, in this embodiment, the clamping feet may have been punched from the girders.

In another embodiment of the invention, the slabs are mounted to the girders by means of fastening members, each comprising a substantially rectangular middle portion of which the one pair of opposite edges connect to fastening lips bent around the flange of the cooperating profile sheet metal girder, and of which the other pair of opposite edges connect to the clamping feet.

BRIEF DESCRIPTION OF THE DRAWINGS

Two embodiments of the invention are illustrated by way of example in the accompanying drawing, of which FIG. 1 is a sectional view through the slabs of a ceiling in accordance with a first embodiment of the invention.

FIG. 2 is a sectional elevation according to line A—A of FIG. 1.

FIG. 3 is a sectional elevation through the slabs of a ceiling according to a second embodiment of the invention.

FIG. 4 is a sectional elevation according to line B—B of FIG. 3.

DETAILED DESCRIPTION OF THE PREFERRED EMBODIMENT

As is shown in FIG. 1 and FIG. 2, the system ceiling is formed by a row of profile sheet metal girders 1 extending parallel to and spaced from each other, and which are suspended from the structure of the building.

From the -U- shaped girders 1 clamping feet 3 are punched with ends bent to form barbs which hook into the slits 5 at the upper side of the slabs 4.

The slabs 4 are provided at the sides with saw cuts 6 into which the firet strips 7 have been slipped.

To mount the system ceiling, the girders 1 may be suspended first from the structure of the building, after which the slabs 4 are pressed until the slits 5 receive the clamping feet 3.

It also is possible to first prepare the complete ceiling on the floor and then to suspend same from the structure of the building by means of the anchors 2.

As is shown in FIG. 3 and in FIG. 4, the slabs 4 are mounted to the girders 1 by means of the fastening members 8 which are provided with the clamping feet 3 and which are clamped around the flange 9 of the profile sheet metal girder 1 by means of the fastening lips 10.

What is claimed is:

1. A system for attaching deformable slabs to structural girders to form system walls or system ceilings, said system comprising:

(a) a plurality of separate deformable slabs, each slab having a pair of channels extending into a side confronting one of said structural girders, each of said channels including a pair of spaced side walls and a bottom wall therebetween, said channels being parallel to one another and spaced apart by a predetermined distance;

(b) a plurality of spaced clamping members, each of said members having a first means which engages said structural girders, and a second means which engages said deformable slabs;

(1) said first means having a pair of adjacently disposed and deformable clamping feet which are integrally joined to one another by a substantially planar base portion extending therebetween, said deformable clamping feet being folded over said structural girder on either side thereof to secure said clamping member to said girder;

(2) said second means defining a pair of angled members extending outwardly from said substantially planar base portion and inclined with respect to said channel side walls to engage said pair of channels defined in said deformable slab, said pair of angled members being spaced apart from one another to span said predetermined distance between the channels defined in said deformable slab, each of said angled members having a second opposingly inclined portion that angles away from the bottom wall of said channels and into the opposing side wall of said channels;

(c) whereby slight pressure against each deformable slab in the direction of the confronting structural girder is sufficient to initiate penetration of said second angled portion into the side walls of each channel of said deformable slab to thereby secure said slab to said clamping member.

2. A system for attaching deformable slabs to structural girders as claimed in claim 1, when said pair of channels extends substantially the entire length of said deformable slabs.

3. A system for attaching deformable slabs to structural girders as claimed in claim 1, wherein said opposingly inclined portions terminate in barbed ends, said barbed ends assisting in the penetration of said side walls of said channels defined by said slabs.

* * * * *